US006912986B2

(12) United States Patent
Higashide et al.

(10) Patent No.: US 6,912,986 B2
(45) Date of Patent: Jul. 5, 2005

(54) ENGINE ACCESSORY SUPPORT ARRANGEMENT

(75) Inventors: Shinji Higashide, Mori-machi (JP); Yoshikazu Takane, Mori-machi (JP)

(73) Assignee: Kabushiki Kaisha YED, Mori-machi (JP)

( * ) Notice: Subject to any disclaimer, the term of this patent is extended or adjusted under 35 U.S.C. 154(b) by 0 days.

(21) Appl. No.: 10/708,582

(22) Filed: Mar. 12, 2004

(65) Prior Publication Data

US 2004/0187832 A1 Sep. 30, 2004

(30) Foreign Application Priority Data

Mar. 26, 2003 (JP) ..... 2003-085388

(51) Int. Cl.[7] ..... F02F 7/00
(52) U.S. Cl. ..... 123/195 A; 123/195 C

(58) Field of Search ..... 123/195 R, 195 A, 123/195 C

(56) References Cited

U.S. PATENT DOCUMENTS 5,509,387 A * 4/1996 Kaminski et al. ..... 123/195 R
6,308,673 B1 * 10/2001 Kobayashi ..... 123/195 C
2003/0015166 A1 * 1/2003 Seymour ..... 123/198 R

FOREIGN PATENT DOCUMENTS

JP HEI6-108919 4/1994

* cited by examiner

*Primary Examiner*—Andrew M. Dolinar
(74) *Attorney, Agent, or Firm*—Ernest A Beutler

(57) ABSTRACT

An improved an accessory mounting arrangement for an internal combustion engine that allows a low mounting position without overstressing the oil pan that provides a part of the support.

5 Claims, 4 Drawing Sheets

ENGINE ACCESSORY SUPPORT ARRANGEMENT

BACKGROUND OF INVENTION

This invention is adapted to be embodied in an internal combustion engine and more particularly to a mounting arrangement for an accessory that is driven by an output shaft of the engine at a relatively low position but is quite secure and does not overstress any engine component.

As is well known, internal combustion engines are particularly utilized to drive a number of accessories, many of which are not essential for the operation of the engine. This is particularly true with vehicle applications where the many of the engine driven accessories serve functions for other vehicle systems such as air conditioning, electrical power generation and power assisting vehicle components other than the engine.

This basically presents problems in both accessory positioning, serviceability, accessory drive and the like. It has therefore been the practice to locate at least some of these accessories quite low and often below the rotational axis of the engine output shaft. An example of such a mounting relation is shown in Japanese Published Application Hei 6-108919. As seen therein the engine has an engine body and support means for allowing an accessory for the engine to be disposed in the outer lateral vicinity of the engine body and to be supported on the engine body,. As is typical, the engine body includes a cylinder block in which cylinder bores are formed. Pistons reciprocate in these cylinder bores and drive the engine crankshaft. This crankshaft is journalled for rotation by the cylinder block and a bulkhead that is secured to the lower face of the cylinder block. Also an oil pan is secured to the lower face of the bulkhead for reserving the engine lubricating oil.

As shown in this publication, the accessory is supported on the oil pan alone. This requires the oil pan sufficiently to support the accessory even though the oil pan is not originally designed for this purpose. However this may cause the configuration of the oil pan to be complicated and also requires the oil pan to be provided with a bulged portion which tends to make the engine oversized.

It is therefore a principle object of the invention to provide an accessory mounting arrangement for an internal combustion engine that allows a low mounting position without overstressing the oil pan that provides a part of the support.

SUMMARY OF INVENTION

This invention is adapted to be embodied in an accessory drive and support for an internal combustion engine that is comprised of an engine body consisting of a cylinder block having at least one cylinder bore, a cylinder head affixed to the cylinder block in closing relation to the cylinder bore and a crankcase assembly affixed to a portion of the cylinder block in spaced relation to the cylinder head. The crankcase assembly includes an oil pan for collecting lubricating oil from the engine. A crankshaft is journalled for rotation about an axis between the cylinder block and the crankcase assembly. The crankshaft is driven by a piston reciprocating in the cylinder bore. The engine accessory has a shaft driven from the crankshaft and is supported directly by the oil pan and by another component of the engine body that is disposed on the other side of the crankshaft axis from the oil pan.

DETAILED DESCRIPTION

Figure 1:
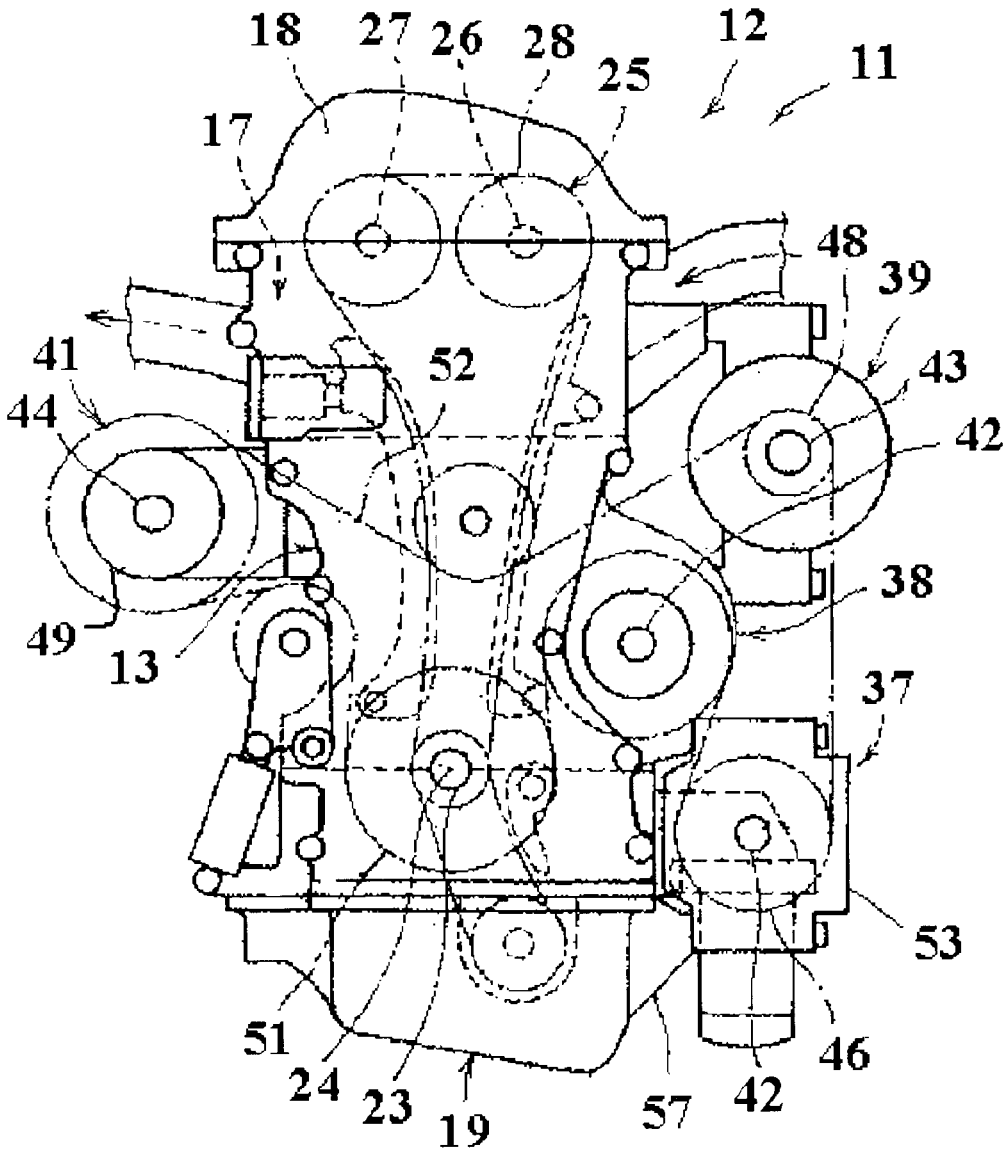
FIG. 1 is a front elevational view of an internal combustion engine and accessory drive constructed in accordance with an embodiment of the invention.
Figure 2:
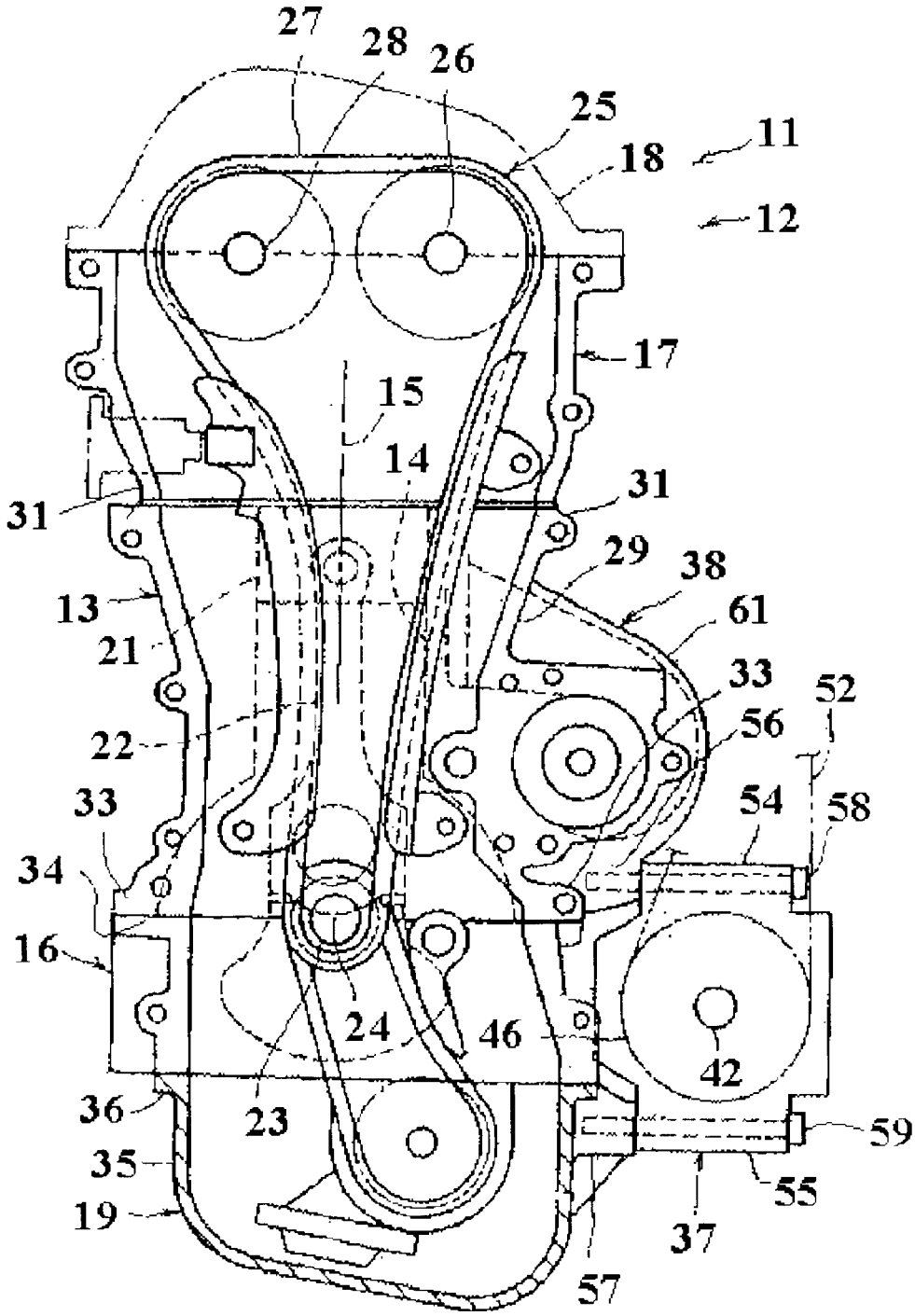
FIG. 2 is an enlarged front elevational view of the engine looking in the same direction as FIG. 1, but with the timing cover of the engine removed.
Figure 3:
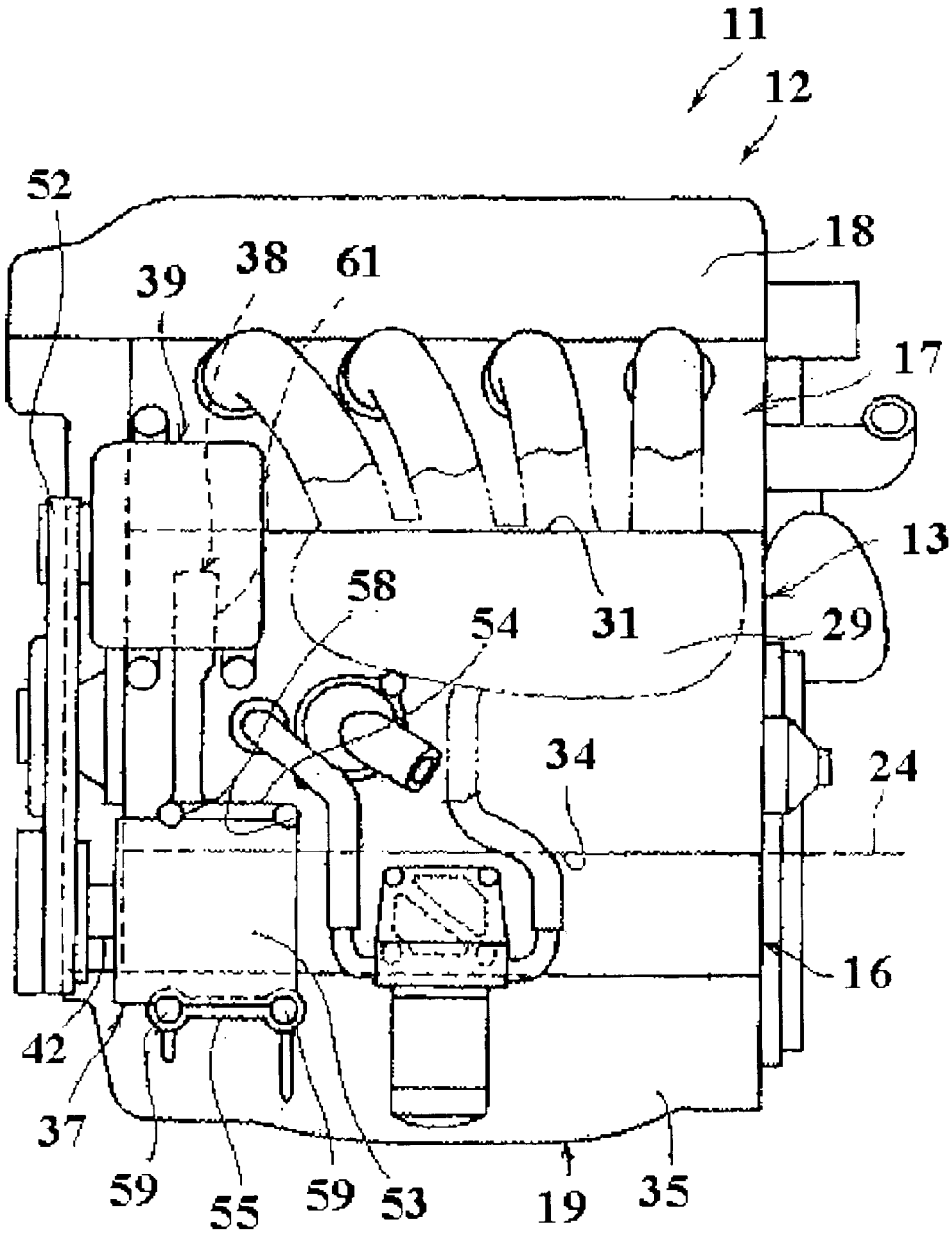
FIG. 3 is a side elevational view of the engine.
Figure 4:
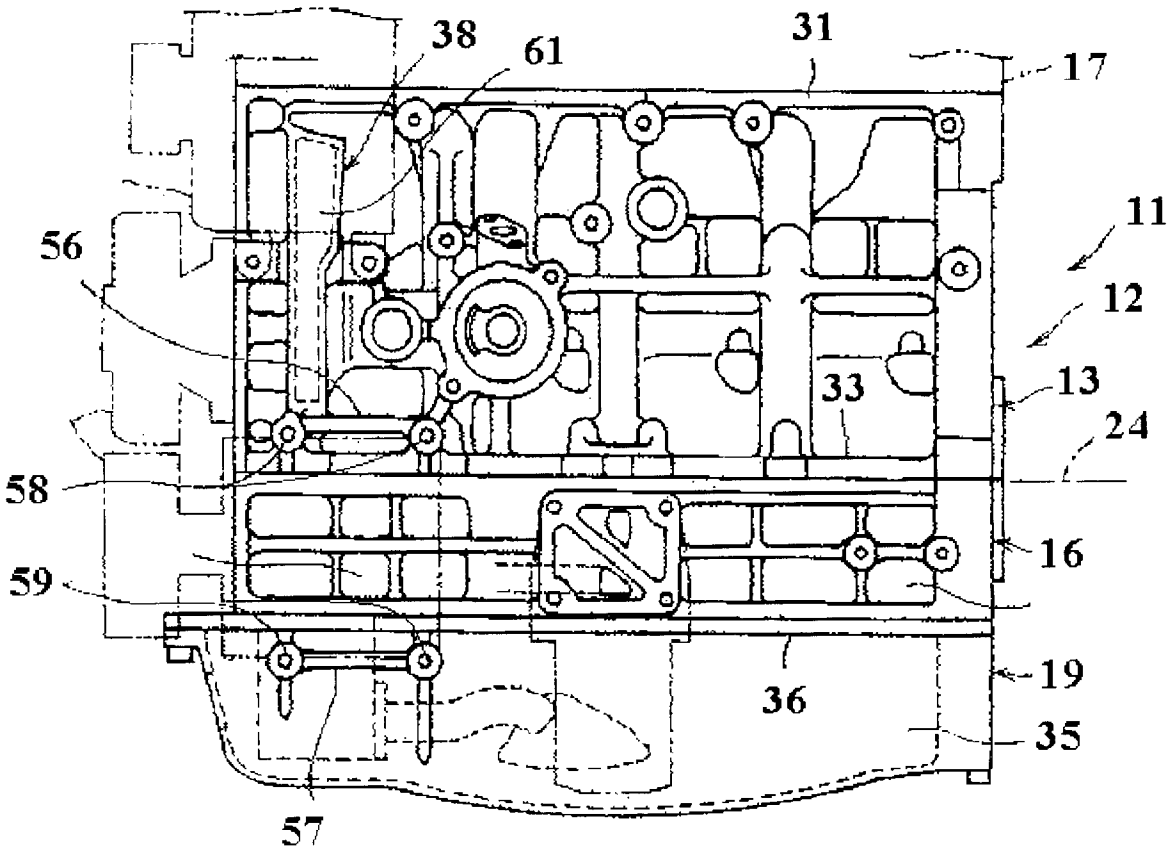
FIG. 4 is a side elevational view looking in the same direction as FIG. 3, showing only the assembled cylinder block and crankcase assembly in solid lines and some of the engine accessories in phantom.

Referring now in detail to the drawings, a multi-cylinder, four-stroke internal combustion engine embodying the invention is indicated generally by the reference numeral 11. In the illustrated embodiment the engine 11 is shown as having four in line cylinders. Of course, from the following description it will be obvious to those skilled in the art, that the invention can be utilized with engines having other numbers of cylinders and other engine configurations. In addition the invention is not limited to engines operating on the four stroke principle.

The engine 11 is adapted to be mounted on and power a vehicle such as an automobile and is depicted as being mounted vertically therein, although the invention is not so limited. The engine 11 has an engine body, indicated generally at 12 supported in a suitable fashion by a vehicle body (not shown). engine body 12 is comprised of a cylinder block, indicated generally at 13. The cylinder block 13 is formed with four cylinder bores 14 having parallel axes 15. Detachably affixed, in a known manner, to the lower end of the cylinder block 13 is a bulkhead, indicated generally at 16, to form the upper portion of a crankcase assembly.

A cylinder head assembly 17 is secured to the upper face of the cylinder block 13 in a known manner and closed the upper ends of the cylinder bores 14. The cylinder head assembly 17 supports valves for controlling the admission of a charge into the engine combustion chambers and the discharge of exhaust gasses therefrom in any suitable manner and as is well known in this art. These valves are operated in a manner to be described. This valve and operating mechanism is enclosed by a cylinder head cover 18 that is secured to the upper face of the cylinder head 17.

The aforedescribed crankcase assembly, the upper portion of which is formed by the lower part of the cylinder block 13 and bulkhead 16 is completed and closed by an oil pan, indicated generally at 19, that is suitably secured to the lower face of the bulkhead 16 and contains lubricating oil.

The engine 11 is provided with pistons 21 reciprocating in the cylinder bores 14 and connected by connecting rods 22 to drive a crankshaft 23. The crankshaft 23 rotates about an axis 24 that extends generally horizontally. The crankshaft 23 is journalled about this axis 24 by bearings carried by the cylinder block 13 and bulkhead 16 in a manner well known in the art.

The aforementioned intake and exhaust valves are operated in a suitable manner by a valve actuating mechanism, indicated generally at 25. This valve actuating mechanism 25 is comprised of an intake camshaft 26 and an exhaust camshaft 27 in suitable operational engagement with the intake valves and exhaust valves, (not shown) respectively. The camshafts 26 and 27 haves axes that extend parallel to the axis 24 of the crankshaft 23. A timing chain 28 interconnects a sprocket provided on one end of the crankshaft 23 with sprockets on the ends of the camshafts 26 and 27 to drive them in timed relation at one half the rotational speed thereof.

As has been noted, the cylinder block 13 is made by casting, and preferably of low pressure cast aluminum. The cylinder block 13 generally comprises a cylinder block body, indicated generally at 29, having a generally cubic shape and in which the plurality of cylinder bores 24 are formed. The body portion 29 has a pair of upper outwardly extending sides 31 defining at their top an upper face 32 that is in suitable sealing contact with the lower face of the cylinder head 17. In a like manner, the sides of body portion 29 has outwardly extending sides 33 that form part of a lower face 34 that is in suitable sealing contact with the upper face of the bulkhead 16. The oil pan 19 has a generally dish-shaped oil pan body 35 opening upward and an outward flange 36 formed integrally with the upper outer edge of the oil pan body 35 that is sealingly engaged with the lower face of the bulkhead 16 to add to the rigidity of the structure.

The engine 11 is provided with a number of accessories disposed in the outer lateral vicinity of the engine body 12, and support means supporting the accessories on the engine body 12. Some of these accessories are for engine operation while others are for vehicle or other purposes. These include an air compressor 37 for vehicle air conditioning, an engine coolant pump 38 for delivering coolant to a coolant jacket formed in the engine body 12 to cool the engine body 12, an alternator 39 for generating electrical power for the vehicle and engine ignition, and a power steering pump 41 for power assist of the vehicle steering. Each of these accessories 37, 38, 39 and 41 has a respective driven input shaft 42, 43, 44 and 45 that have their rotational axes extending parallel with the axis 24 of the crankshaft 23. Respective drive pulleys 46, 47, 48 and 53 are affixed respectively to the accessory driven input shafts 42, 43, 44 and 45. These pulleys are all driven from a pulley 51 that is affixed to the crankshaft 23 by means of a serpentine belt 52.

The air compressor 37 is provided has a compressor body 53 in which the input shaft 42 is journalled in any known manner. Upper and lower brackets 54 and 55 protrude integrally from the compressor body 53. The upper bracket 55 cooperates in a manner to be described with an upper support portion 56 integrally protruding laterally outward from the lower end of the cylinder block 13. In addition, a lower support portion 57 integrally protruding laterally outward from the upper end of the oil pan 19 that cooperates with the lower bracket 55. A first pair of fasteners 58 fasten the upper bracket 54 to the upper support portion 56, and a second pair of fasteners 59 fastening the lower bracket 55 to the lower support portion 57.

Thus the air compressor 37 is supported by both ends being secured to the cylinder block 13 and the oil pan 19 and spanning the bulkhead 16. Nevertheless the compressor body 53 is positioned in the outer lateral area of a vertical area of the bulkhead 16. In addition, at least part of the upper support portion 56 is formed integrally with the lower outer flange 27 of the cylinder block 13 for reinforcement. Also, at least part of the lower support portion 57 is formed integrally with the outer flange 36 of the oil pan 19 for reinforcement. Specifically, the part of the compressor body 53 defining the axis 44 of the input shaft 43, protrudes forward from the bulkhead 16 to a greater extent than the upper and lower brackets 54, 55.

Because the compressor 36 is supported on the engine body 12, the external force applied by the compressor 36 is not only shared by the cylinder block 13 and the oil pan 19, but also shared indirectly by the bulkhead 16, which is overlain by the compressor 36. Therefore, the support strength of the compressor 36 on the engine body 12 can be more securely improved.

The engine coolant pump 38 is provided with a casing 61 that forms its outer shell. This is disposed in the outer lateral area of the cylinder block 13 on the same side as the air compressor 37. This casing 61 is formed integrally with the outer lateral face of the cylinder block 13 and thus reinforces it. At least part of the lower end of the casing 61 is formed integrally with the upper support portion 56, that is, the upper portion of the air compressor 37 is supported on the cylinder block 13 in the vicinity of the casing 61.

Therefore and as described above, the support of the compressor 37 on the engine body 12 is effectively improved by supporting the compressor 37 on both the lower end of the cylinder block 13 and the upper end of the oil pan 19. Since at least part of the compressor body 53 is positioned in the outer lateral area of the midsection of the bulkhead 16 in the vertical direction, the part of the compressor body 53 can be disposed closer to the crankshaft 23 without obstruction by the outward flanges 36 and/or with the use of the recess in the bulkhead 16 so that the compressor 37 can be arranged in a compact manner, thereby preventing the engine 11 from being oversized. Furthermore, since the compressor 37 can be positioned closer to the crankshaft 23, the configuration of the drive belt 52 interconnecting the compressor 37 and the crankshaft 23 can be shorter.

Of course those skilled in the art will readily understand that the described embodiment is only exemplary of forms that the invention may take and that various changes and modifications may be made without departing from the spirit and scope of the invention, as defined by the appended claims. For examples only, the engine 21 may be a two-stroke engine and/or the axes 25 of the cylinder bores 24 may be inclined with respect to the vertical. Also the compressor 37 may be driven from another power source than the engine 11 itself.

What is claimed is:

1. An internal combustion engine comprised of an engine body consisting of a cylinder block having at least one cylinder bore, a cylinder head affixed to said cylinder block in closing relation to said cylinder bore, a crankcase assembly affixed to a portion of said cylinder block in spaced relation to said cylinder head and including an oil pan for collecting lubricating oil from said engine, a crankshaft journalled for rotation about an axis between said cylinder block and said crankcase assembly and driven by a piston reciprocating in said cylinder bore, an engine accessory disposed on a side of said engine and between the ends of said crankshaft and having a shaft driven from said crankshaft and supported directly by said oil pan and another component of said engine body that is disposed on the other side of a mating plane between said cylinder block and said crankshaft assembly from said oil pan.

2. An internal combustion engine as set forth in claim 1 wherein the crankcase assembly includes a bulkhead interposed between the cylinder block and the oil pan, said bulkhead serving to journal the crankshaft with the cylinder block.

3. An internal combustion engine comprised of an engine body consisting of a cylinder block having least one cylinder bore, a cylinder head affixed to said cylinder block in closing relation to said cylinder bore, a crankcase assembly affixed to a portion of said cylinder block in spaced relation to said cylinder head and including an oil pan for collecting lubricating oil from said engine, a crankshaft journalled for rotation about an axis between said cylinder block and said crankcase assembly and driven by a piston reciprocating in said cylinder bore, an engine accessory disposed on a side of said engine and between the ends of said crankshaft and having a shaft driven from said crankshaft and supported directly by said oil pan and another component of said engine body that is disposed on the other vertical side of crankshaft axis from the oil pan and not directly supported by said bulkhead.

4. An internal combustion engine as set forth in claim 3 wherein the engine accessory is supported by fasteners received in the oil pan and the other component.

5. An internal combustion engine as set forth in claim 4 wherein the other component is the cylinder block.

* * * * *

UNITED STATES PATENT AND TRADEMARK OFFICE

CERTIFICATE OF CORRECTION

PATENT NO. : 6,912,986 B2
APPLICATION NO. : 10/708582
DATED : July 5, 2005
INVENTOR(S) : Shinji Higashide It is certified that error appears in the above-identified patent and that said Letters Patent is hereby corrected as shown below:

Col. 4, lines 34-49, Claim 1 should read as follows:
An internal combustion engine comprised of an engine body consisting of a ]cylinder block having at least one cylinder bore, a cylinder head affixed to said cylinder block in closing relation to said cylinder bore, a crankcase assembly affixed to a portion of said cylinder block in spaced relation to said cylinder head and including an oil pan for collecting lubricating oil from said engine, a crankshaft journalled for rotation about an axis between said cylinder block and said crankcase assembly and driven by a piston reciprocating in said cylinder bore, an engine accessory disposed on a side of said engine and between the ends of said crankshaft and having a shaft driven from said crankshaft and supported directly by said oil pan and another component of said engine body] that is disposed on the other side of a mating plane between said cylinder block and said crankcase assembly from said oil pan.

UNITED STATES PATENT AND TRADEMARK OFFICE

CERTIFICATE OF CORRECTION

PATENT NO. : 6,912,986 B2
APPLICATION NO. : 10/708582
DATED : July 5, 2005
INVENTOR(S) : Shinji Higashide It is certified that error appears in the above-identified patent and that said Letters Patent is hereby corrected as shown below:

Col. 4, lines 55-67, Claim 3 should read as follows:
3. An internal combustion engine comprised of an engine body consisting of a cylinder block having at least one cylinder bore, a cylinder head affixed to said cylinder block in closing relation to said cylinder bore, a crankcase assembly affixed to a portion of said cylinder block in spaced relation to said cylinder head and including an oil pan for collecting lubricating oil from said engine and a bulkhead interposed between said cylinder block and said oil pan, a crankshaft journalled for rotation about an axis between said cylinder block and said crankcase assembly and driven by a piston reciprocating in said cylinder bore, an engine accessory disposed on a side of said engine and between the ends of said crankshaft and having a shaft driven from said crankshaft and supported directly by said oil pan and another component of said engine body that is disposed on the other vertical side of crankshaft axis from the oil pan and not directly supported by said bulkhead.

Signed and Sealed this

Twelfth Day of August, 2008

JON W. DUDAS
*Director of the United States Patent and Trademark Office*